US011241597B2

(12) United States Patent
Chen et al.

(10) Patent No.: US 11,241,597 B2
(45) Date of Patent: Feb. 8, 2022

(54) VENTILATION FAN

(71) Applicant: DELTA ELECTRONICS, INC., Taoyuan (TW)

(72) Inventors: Chun-Wei Chen, Taoyuan (TW); Wen-Hsiang Lin, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 369 days.

(21) Appl. No.: 16/388,505

(22) Filed: Apr. 18, 2019

(65) Prior Publication Data

US 2019/0240516 A1 Aug. 8, 2019

Related U.S. Application Data

(63) Continuation of application No. 14/815,597, filed on Jul. 31, 2015, now abandoned.

(51) Int. Cl.

| | |
|---|---|
| ***A62C 2/14*** | (2006.01) |
| ***F24F 7/013*** | (2006.01) |
| ***F24F 13/14*** | (2006.01) |
| *F24F 11/33* | (2018.01) |

(52) U.S. Cl.

CPC ..... *A62C 2/14* (2013.01); *F24F 7/013* (2013.01); *F24F 13/14* (2013.01); *F24F 11/33* (2018.01); *F24F 2221/30* (2013.01)

(58) Field of Classification Search

CPC ... A62C 2/14; F24F 7/013; F24F 13/14; F24F 11/33; F24F 2221/30; F24F 13/0209; F16B 5/0004; F16B 2200/503; F16B 5/008

USPC ..... 454/369

See application file for complete search history.

(56) References Cited

U.S. PATENT DOCUMENTS

| | | | | |
|---|---|---|---|---|
| 5,171,184 | A * | 12/1992 | Saucier | A62C 2/16 160/1 |
| 6,261,175 | B1 * | 7/2001 | Larson | F24F 7/007 415/204 |
| 9,533,179 | B2 | 1/2017 | Long et al. | |
| 2013/0130613 | A1 * | 5/2013 | Long | F24F 7/007 454/369 |
| 2013/0306746 | A1 | 11/2013 | Plew, Sr. | |

* cited by examiner

*Primary Examiner* — Edelmira Bosques
*Assistant Examiner* — Ryan L Faulkner
(74) *Attorney, Agent, or Firm* — Muncy, Geissler, Olds & Lowe, P.C.

(57) ABSTRACT

A ventilation fan according to the invention comprises a fan module, a fire damper module and a cover module. The fire damper module comprises a link frame, a fire damper body and an adjustment element. The fire damper body is disposed in the link frame and detachably linked up with the link frame. The adjustment element is disposed on the fire damper body and near an opening of a flange of the fire damper body. The adjustment element comprises a fixed portion, a stop portion and a trace portion. Wherein the stop portion abuts and shields the opening when no electrical wire passing through the opening. Wherein when the cover module comprises an electronic device having an electrical wire, the trace portion abuts the opening and the electrical wire passing through the trace portion and the opening to connect to the fan module.

15 Claims, 7 Drawing Sheets

VENTILATION FAN

CROSS REFERENCE TO RELATED APPLICATIONS

This application is a Continuation Application (CA) of an earlier filed, pending, application, having application Ser. No. 14/815,597 and filed on Jul. 31, 2015, the content of which, including drawings, is expressly incorporated by reference herein.

BACKGROUND

Technical Field

The invention relates to a ventilation fan.

Related Art

For noise reduction, heat or fire insulation and prevention of cool air leakage, the interior space of modern building generally constitute unventilated rooms by special building materials, but it is accordingly inadequate to ventilate and incapable of discharging harmful pollutants. To improve air convection in the room, ventilation fans have been installed in many buildings to keep fresh air. Based on security consideration, the ventilation fan further integrate the fire damper to prevent flame and smoke from passing through the ventilation fan and entering air passage to other rooms if fire occurs.

However, when the maintaining the ventilation fan, the user needs to disassemble the fire damper first and then maintain it, and it is quite inconvenient. Besides, when fire occurs, it is dangerous that the fire damper is not able to actually close due to the electrical wire if the electrical wire passes through the fire damper and other electronic device and the ventilation fan share the power supply.

SUMMARY

A ventilation fan according to the invention comprises a fan module, a fire damper module and a cover module. The fan module comprises a housing having an air intake and an air outtake. The fire damper module is disposed in the air intake and comprises a fire damper body and an adjustment element. The fire damper body has a flange extending inwardly on the inner surface thereof and the flange has an opening. The adjustment element is disposed near the opening and on one closer side of the flange to the fan module. The cover module is disposed on the fire damper module.

In one embodiment, the adjustment element comprises a fixed portion, a stop portion and a trace portion. The fixed portion has a fixed hole and a securing unit passes through the fixed hole to secure the fixed portion to the fire damper body. The stop portion, connected to the fixed portion. The trace portion is connected to the fixed portion and has an abutment terminal. The abutment terminal and the stop portion are substantially symmetric about the fixed hole.

In one embodiment, the stop portion shields the opening.

In one embodiment, the cover module has a cover body and an electronic device connected to the cover body.

In one embodiment, the trace portion has a notch, the abutment terminal abuts the surrounds of the opening so the notch communicates with the opening, and an electrical wire of the electronic device passes through the opening and the notch to connect to the fan module.

A ventilation fan according to the invention comprises a fan module, a fire damper module and a cover module. The fan module comprises a housing having an air intake and an air outtake. The fire damper module is disposed in the air intake and comprises a link frame and a fire damper body. The link frame is linked up with the fan module. The fire damper body is disposed in the link frame and linked up with the link frame, and has a flange extending inwardly on the inner surface thereof. The flange has an opening. The cover module is disposed on the fire damper module.

In one embodiment, the fire damper module further comprises an adjustment element which is disposed near the opening and on one closer side of the flange to the fan module.

In one embodiment, the adjustment element comprises a fixed portion, a stop portion and a trace portion. The fixed portion has a fixed hole and a securing unit passes through the fixed hole to secure the fixed portion to the fire damper body. The stop portion is connected to the fixed portion. The trace portion is connected to the fixed portion and has an abutment terminal. The abutment terminal and the stop portion are substantially symmetric about the fixed hole.

In one embodiment, the stop portion shields the opening.

In one embodiment, the cover module has a cover body and an electronic device connected to the cover body.

In one embodiment, the trace portion has a notch, the abutment terminal abuts the surrounds of the opening so the notch communicates with the opening, and an electrical wire of the electronic device passes through the opening and the notch to connect to the fan module.

As mentioned above, because of the fire damper module of the ventilation fan, the user can install the adjustment element on demand. For example, when the cover module has an electronic device, the electrical wire of the electronic device can pass through the opening and the trace portion to connect to the fan module. Alternatively, when the cover module does not have the electronic device, the user can rotate the adjustment element 180 degrees to install so the stop portion of the adjustment element can shield the opening. Besides, in some embodiments, because the fire damper module has the link frame, the user only needs to detach the fire damper body from the link frame and then he can uninstall the fan body from the ceiling so as to improve the convenience of installing and maintaining the ventilation fan.

BRIEF DESCRIPTION OF THE DRAWINGS

The embodiments will become more fully understood from the detailed description and accompanying drawings, which are given for illustration only, and thus are not limitative of the present invention, and wherein.

DETAILED DESCRIPTION OF THE INVENTION

The embodiments of the invention will be apparent from the following detailed description, which proceeds with reference to the accompanying drawings, wherein the same references relate to the same elements.

Figure 1A:
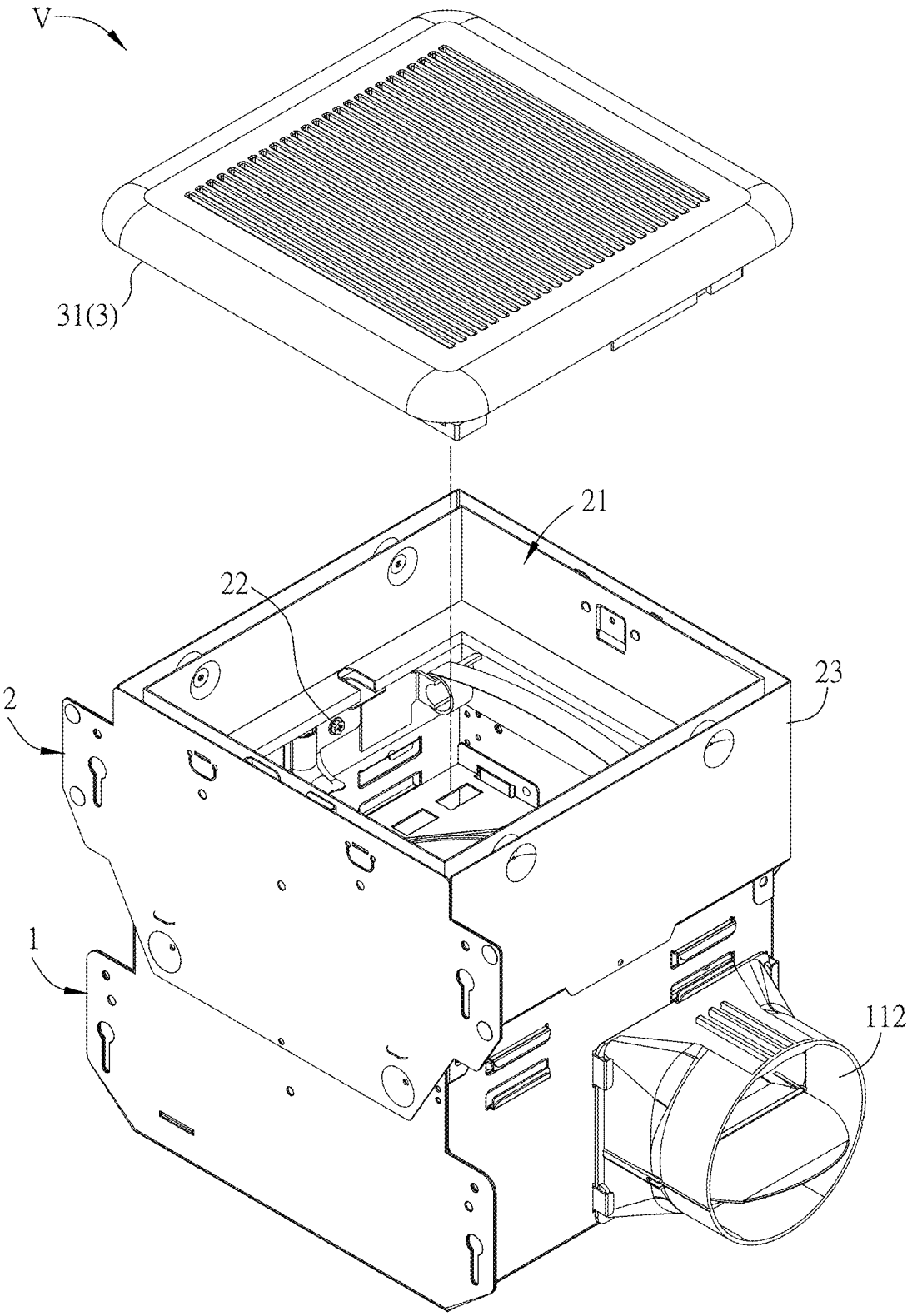
FIG. 1A is a schematic diagram showing a ventilation fan according to the first embodiment of the invention.
Figure 1B:
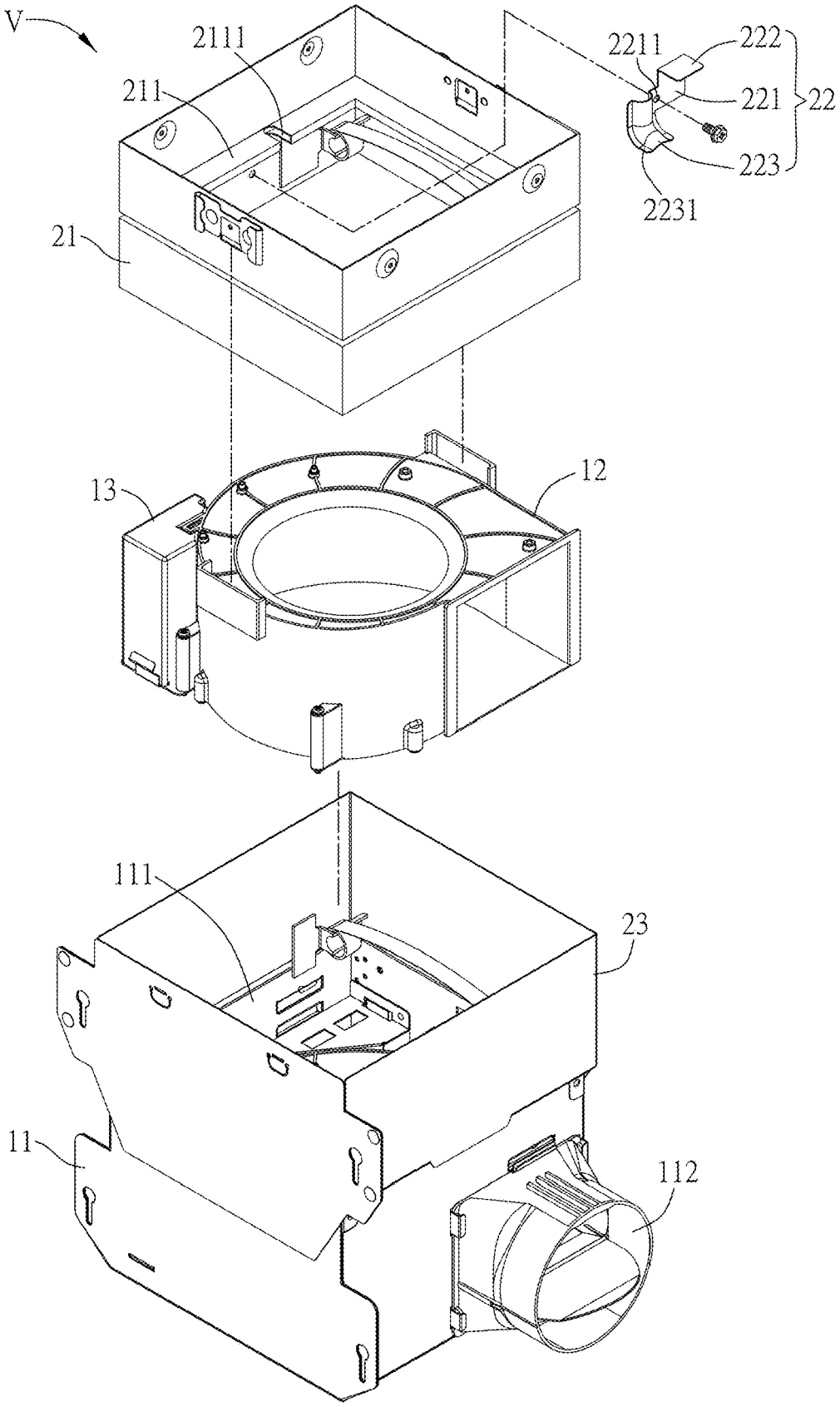
FIG. 1B is an exploded view showing the ventilation fan in FIG. 1A.

FIG. 1A is a schematic diagram showing a ventilation fan according to the first embodiment of the invention. FIG. 1B is an exploded view showing the ventilation fan in FIG. 1A, but FIG. 1B does not show the cover module in FIG. 1A. Referring to FIG. 1A and FIG. 1B, the ventilation fan V is generally installed on the ceiling and it includes a fan module 1, a fire damper module 2, and a cover module 3. The fan module 1 is linked up with the fire damper module 2, the cover module 3 is disposed on the fire damper module 2, and the fire damper module 2 is located between the fan module 1 and the cover module 3.

The fan module 1 includes a housing 11 and a fan body 12. The fan body 12 is disposed in the housing 11. In the embodiment, the housing 11 is roughly a cuboid and has an air intake 111 and an air outtake 112. The air intake 111 and the air outtake 112 are respectively located at distinct planes of the housing 11, for example two adjacent planes or two opposite planes. In the embodiment, they are respectively located at two adjacent planes for example. Moreover, the opening plane of the air intake 111 is preferably parallel to the ceiling.

The fan body 12 may be an axial fan or a centrifugal fan. In the embodiment, it is a centrifugal fan for example but not limited thereto. Besides, the fan module 1 further includes a power supply 13 which is electrically connected to mains electricity and provides it for the fan body 12.

Figure 2:
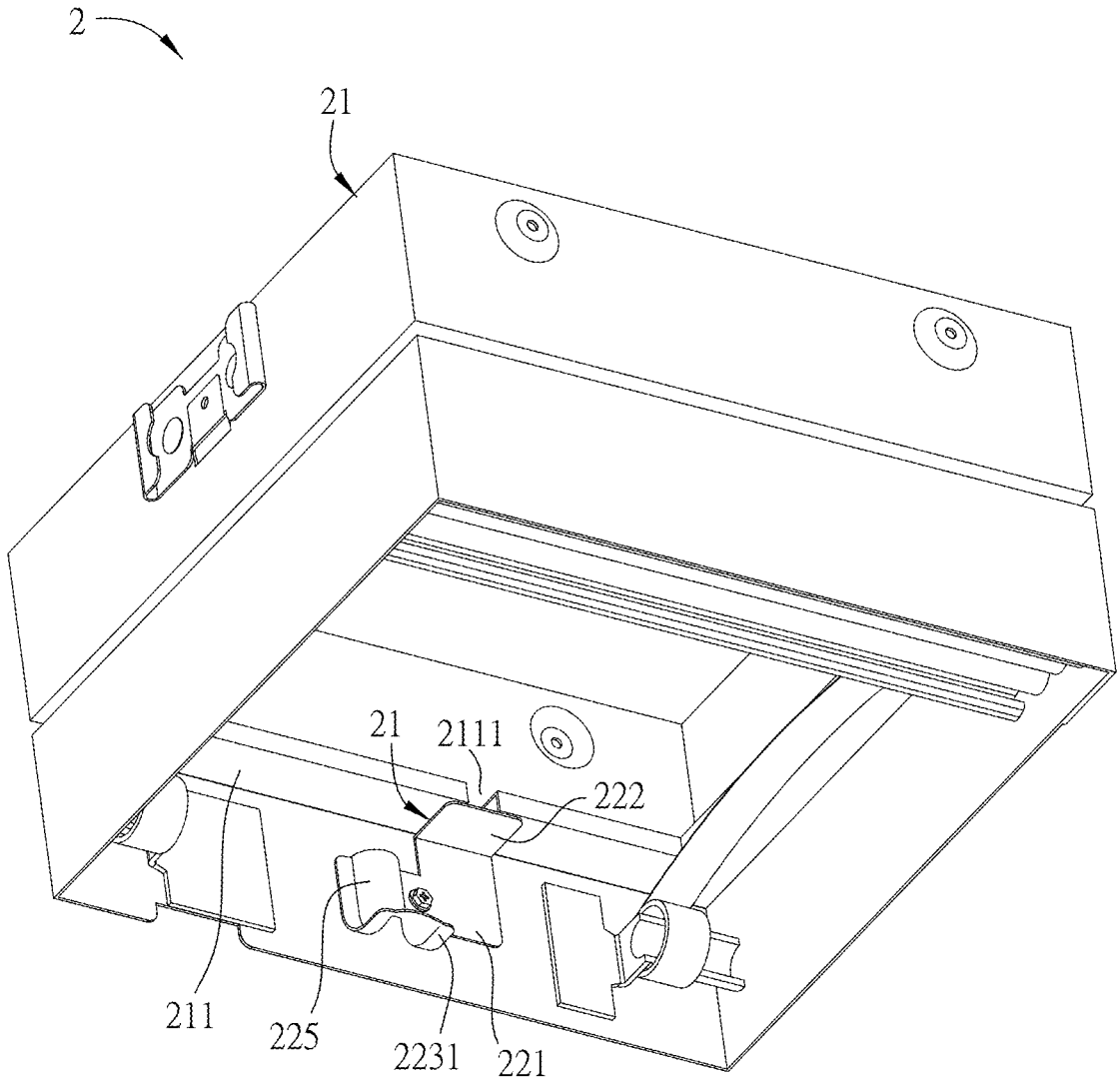
FIG. 2 is a schematic diagram showing the fire damper module.

FIG. 2 is a schematic diagram showing the fire damper module, and it is a schematic diagram at a viewing angle from the fan module to the fire damper module. Referring to FIGS. 1A, 1B, and 2, the fire damper module 2 is linked up with the air intake 111, and it includes a fire damper body 21, an adjustment element 22, and a link frame 23 (not shown in FIG. 2). The link frame 23 is linked up with the fan module 1. The fire damper body 21 is disposed in the link frame 23 and linked up with the link frame 23, for example by screw, latch, or concave-convex match. Therefore, benefited from the design of the link frame 23 and the fire damper body 21, the user connects the fan module 1 to the link frame 23 for combination and fixation, and puts them on the ceiling during installation process of the ventilation fan V. Then, the user disposes and fixes the fire damper body 21 in the link frame 23. It is easier to assemble the ventilation fan V. Moreover, when the fan body 12 needs repair or maintenance, the user only needs to detach the fire damper body 21 from the link frame 23 and the user can just take out the fan body 12. It is not necessary to uninstall the whole ventilation fan V from the ceiling first to detach the fan body 12. Therefore, it is more convenient to maintain.

The fire damper body 21 is roughly a square ring-shaped wall and includes four sidewalls. The fire damper body 21 has a flange 211 extending inwardly on its inner surface, namely, the flange 211 is perpendicular to the sidewalls of the fire damper body 21. In the embodiment, the flange 211 is disposed on the four sidewalls to form the flange structure of square ring shape. Alternatively, the flange 211 may be only formed on one sidewall, and it is not limited thereto.

Figure 3A:
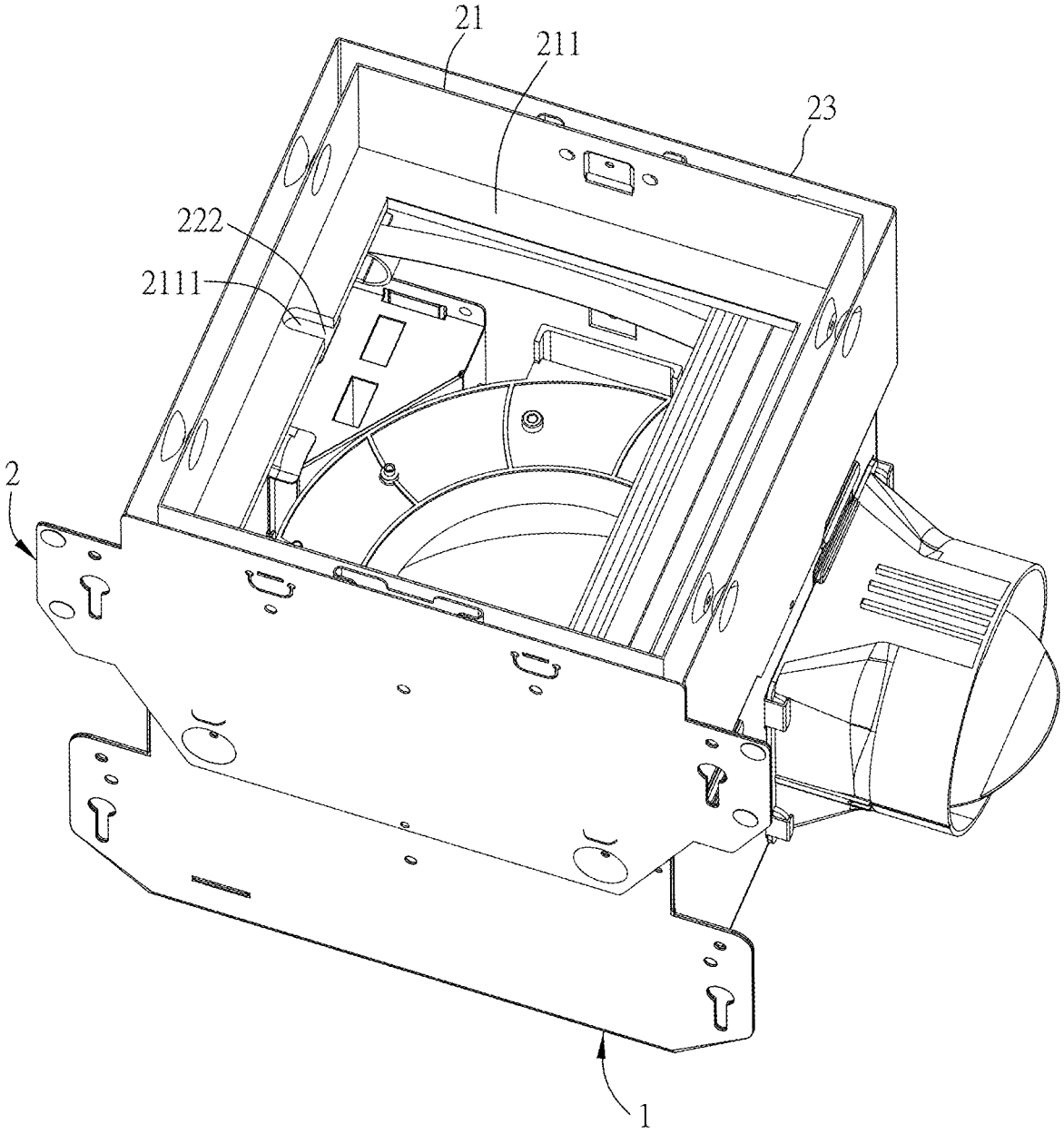
FIG. 3A and FIG. 3B are schematic diagrams showing the fire damper module in operation.
Figure 3B:
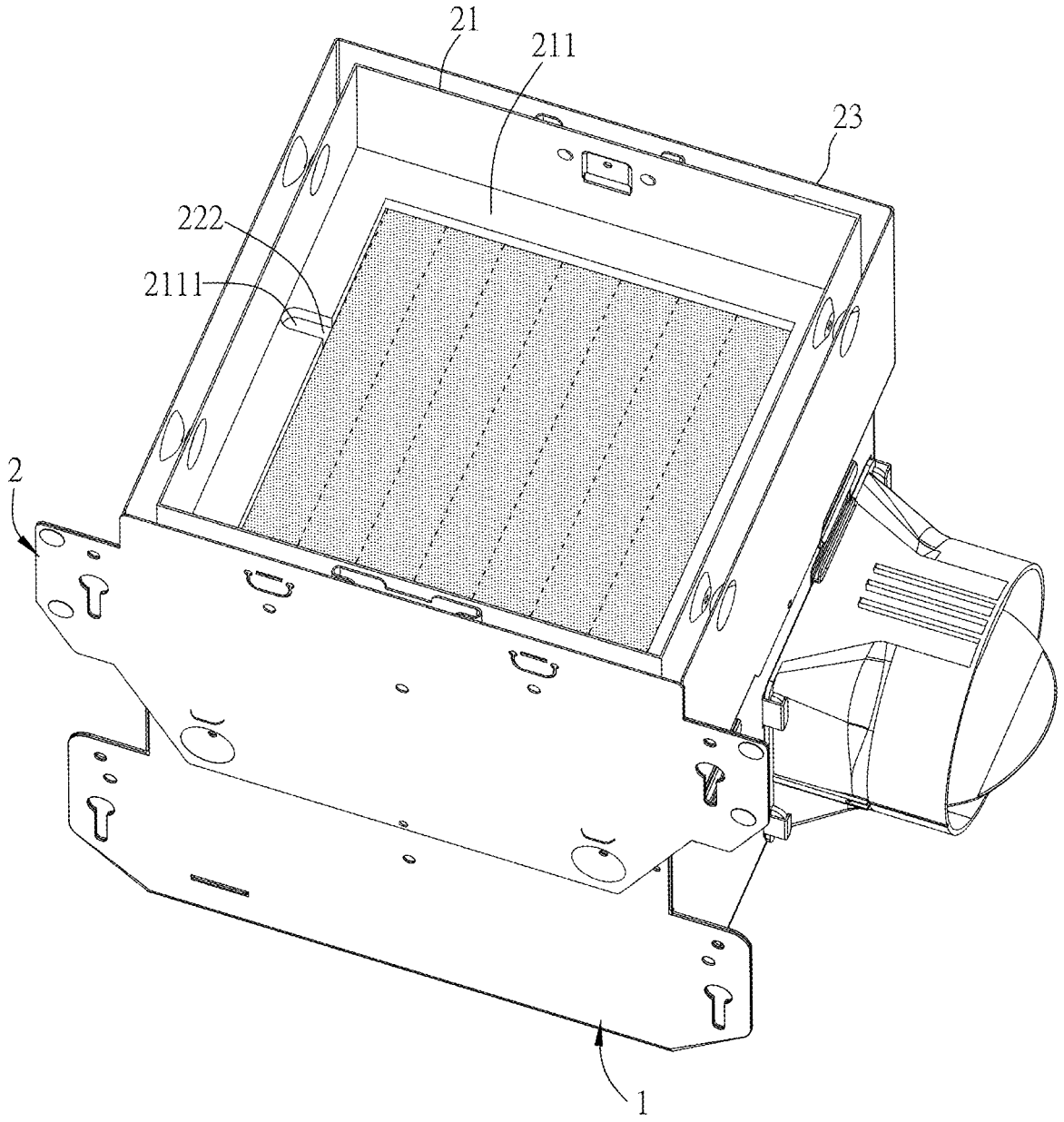

The flange 211 has an opening 2111, the adjustment element 22 is disposed near the opening 2111 and on one closer side of the flange 211 to the fire damper module 2, and the opening 2111 communicates with the spaces at the two opposite sides of the flange 211. Moreover, the fire damper body 21 further includes fire curtains 212 (or fire shutters) and safety device. The safety device may be metal material which fixes the fire curtains 212 to a sidewall of the fire damper body 21 and enables the fire damper body 21 to normally open as shown in FIG. 3A. When fire occurs, the safety device fuses due to high temperature and thus the fire curtains 212 face another opposite sidewall to close the fire damper body 21 so as to isolate flame and smoke from entering as shown in FIG. 3B.

In the embodiment, the adjustment element 22 is a metal plate, and it includes a fixed portion 221, a stop portion 222 and a trace portion 223. The fixed portion 221 has a fixed hole 2211, and a securing unit S passes through the fixed hole 2211 to secure the fixed portion 221 to the fire damper body 21. The stop portion 222 and the trace portion 223 are respectively connected to the fixed portion 221, and the fixed portion 221 is located between the stop portion 222 and the trace portion 223. The stop portion 222 and the fixed portion 221 are connected vertically. The trace portion 223 has a notch, for example an arc notch. Besides, the trace portion 223 has an abutment terminal 2231. The abutment terminal 2231 and the stop portion 222 are parallel to each other, and they are substantially symmetric about the fixed hole 2211. In other words, the distance from the fixed hole 2211 to the stop portion 222 is about equal to the distance from the fixed hole 2211 to the abutment terminal 2231, and the fixed hole 2211, the stop portion 222, and the abutment terminal 2231 are located at the same straight line.

In the embodiment, when the user disposes the adjustment element 22 on the fire damper body 21, the stop portion 222 abuts the opening 2111 so the stop portion 222 shields the opening 2111. When fire occurs and the fire curtains 212 close accordingly, flame and smoke would not pass through the opening 2111 to the fan module 1 and they are actually isolated.

Referring to FIG. 1A again, the cover module 3 has a cover body 31 thereof, which is a square lid and has grid structure. The cover body 31 may be linked up with the fire damper module 2 for example but not limited to by screw, elastic sheet, engaging piece, etc. By the disposal of the cover module 3, the internal structures of the fire damper module 2 and the fan module 1 are hidden and invisible for aesthetic reasons.

Figure 4A:
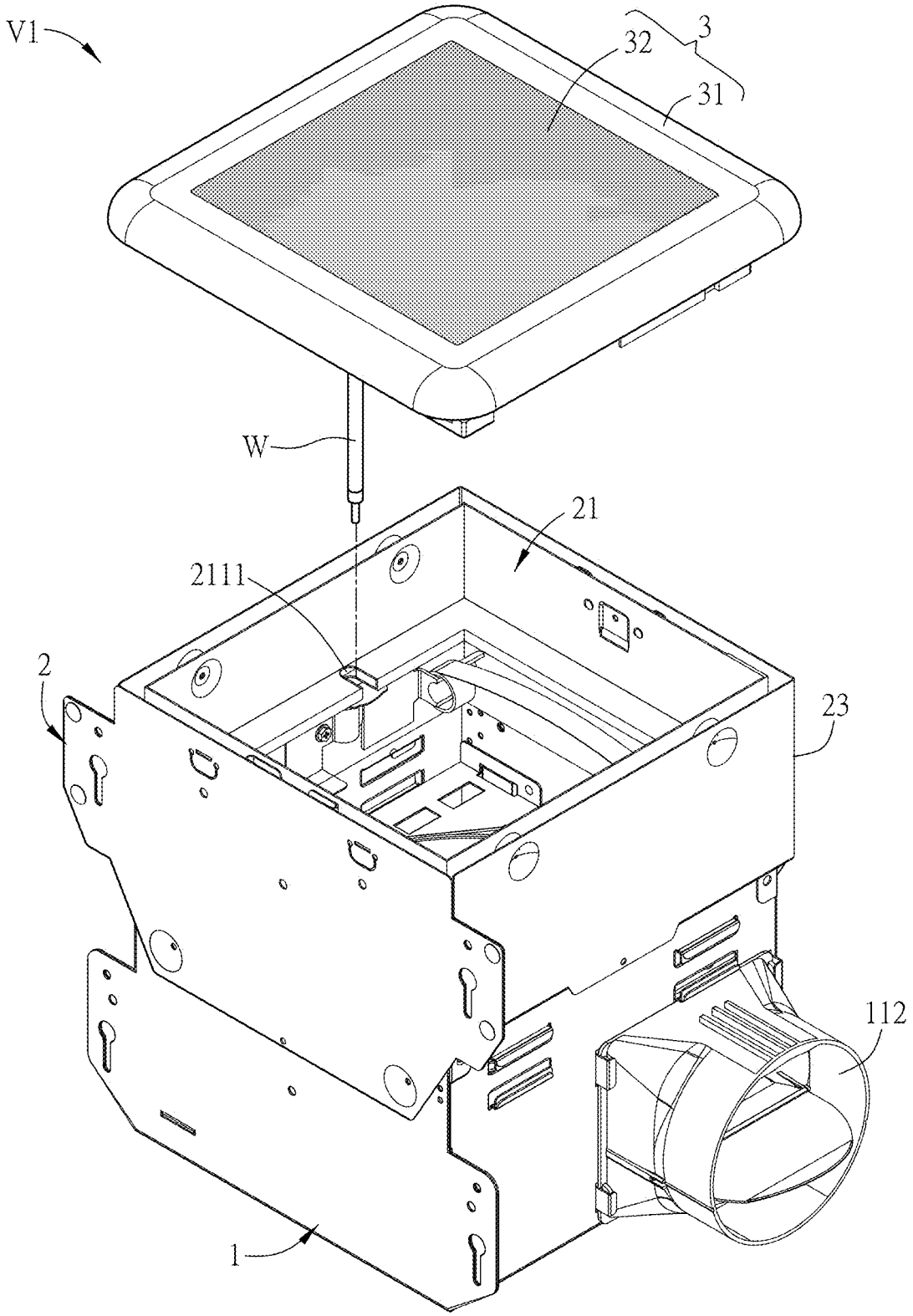
FIG. 4A is a schematic diagram showing a ventilation fan according to the second embodiment of the invention.
Figure 4B:
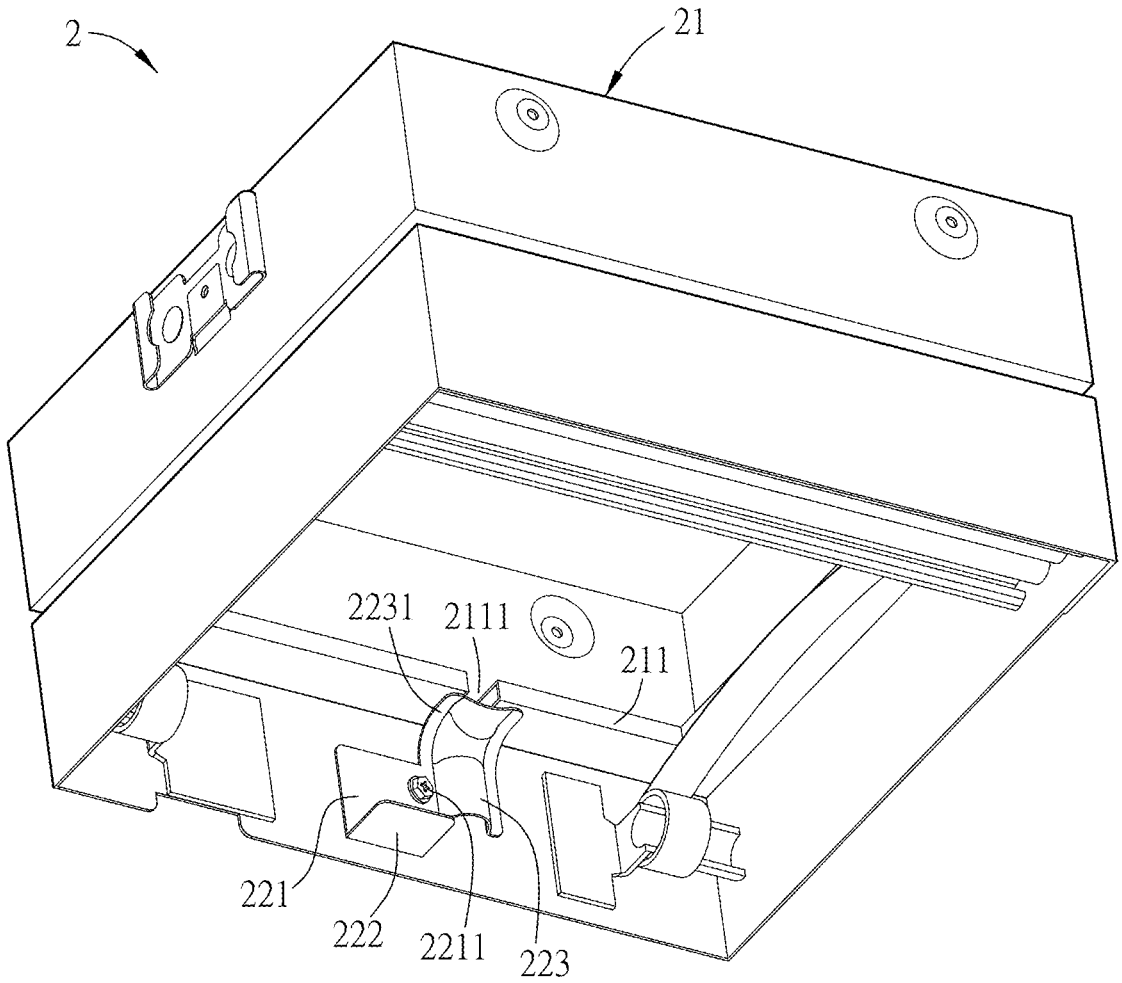
FIG. 4B is a schematic diagram showing the fire damper module of FIG. 4A.

FIG. 4A is a schematic diagram showing a ventilation fan according to the second embodiment of the invention. FIG. 4B is a schematic diagram showing the fire damper module of FIG. 4A. Referring to FIG. 4A and FIG. 4B, in the embodiment, the cover module 3 of the ventilation fan V1 further includes an electronic device 32. The electronic device 32 is connected to the cover body 31. For example, the electronic device 32 may be embedded in the cover body 31, or alternatively, the cover body 31 may have an accommodation space at its side toward the fire damper module 2 to accommodate the electronic device 32. The accommodation space and the electronic device 32 may matched by wedging or combine by chutes. Besides, the electronic device 32 may be linked up with the cover body 31 for example by screw, elastic sheet, engaging piece, etc., and it is not limited thereto. For example, the electronic device 32 may be stereo set, smoke detector, lamp, light sensor, control panel, or other electronic products. The power cord of the electronic device 32 is connected to the power supply 13 so that the power supply 13 can provide necessary electrical power for the electronic device 32. In the embodiment, a lamp is taken for example.

In the embodiment, the orientation of the adjustment element 22 is different from that of the above embodiment. After the adjustment element 22 is rotated 180 degrees about the fixed hole 2211, the abutment terminal 2231 of the trace portion 223 abuts the opening 2111, so the notch of the trace portion 223 and the sidewall of the fire damper body 21 jointly form an accommodation which communicates with the opening 2111 of the flange 211. As a result, the electrical wire W (as shown in FIG. 4A) of the electronic device (for example the power cord) may pass through the opening 2111 and the accommodation groove to connect to the power supply 13 of the fan module 1 (as shown in FIG. 1B). In other words, when the cover module 3 does not have the electronic device 32 thereof, the user may fix the adjustment element 22 by the stop portion 222 abutting the opening 2111 so as to actually isolate flame and smoke from entering the fan module 1. When the cover module 3 has the electronic device 32 thereof, the user can fix the adjustment element 22 along the orientation of the trace portion 223 communicating with the opening 2111. Thus, the power cord of the electronic device 32 may pass through the opening 2111 and the trace portion 223 to connect to the power supply 13. When fire occurs and the fire curtains 212 close accordingly, the power cord of the electronic device 32 would not be damaged and impacted by the closing fire curtains 212. The power cord also would not interfere with the fire curtains 212 when it should be closed, so the problems of not actually isolating flame and smoke would not occur.

It is noted that in all embodiments, the variation of each element, component or unit could be mutually applied to any embodiments, and they are not only limited to the embodiments mentioned above.

As mentioned above, because of the fire damper module of the ventilation fan, the user can install the adjustment element on demand. For example, when the cover module has an electronic device, the electrical wire of the electronic device can pass through the opening and the trace portion to connect to the fan module. Alternatively, when the cover module does not have the electronic device, the user can rotate the adjustment element 180 degrees to install so the stop portion of the adjustment element can shield the opening. Besides, in some embodiments, because the fire damper module has the link frame, the user only needs to detach the fire damper body from the link frame and then he can uninstall the fan body from the ceiling so as to improve the convenience of installing and maintaining the ventilation fan.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A ventilation fan, comprising:

a fan module, comprising a housing having an air intake and an air outtake;

a fire damper module, disposed in the air intake and comprising:

a link frame, linked up with the housing;

a fire damper body, disposed in the link frame and detachably linked up with the link frame, the fire damper body comprises a flange and fire curtains, the flange extends inwardly on the inner surface of the fire damper body, wherein the flange has an opening; and an adjustment element, disposed on the fire damper body and near the opening, the adjustment element comprises a fixed portion, a stop portion and a trace portion, the stop portion and the trace portion are respectively connected to the fixed portion, and the fixed portion is located between the stop portion and the trace portion; and a cover module, disposed on the fire damper module;

wherein the stop portion abuts and shields the opening when no electrical wire passing through the opening; and wherein when the cover module comprises an electronic device having an electrical wire, the trace portion abuts the opening and the electrical wire passing through the trace portion and the opening to connect to the fan module;

wherein the adjustment element is rotated 180 degrees so that the trace portion abuts the opening.

2. The ventilation fan of claim 1, wherein the fixed portion has a fixed hole, a securing unit passes through the fixed hole to secure the fixed portion to the fire damper body.

3. The ventilation fan of claim 2, wherein the trace portion comprises an abutment terminal, the abutment terminal and the stop portion are substantially symmetric about the fixed hole.

4. The ventilation fan of claim 3, wherein the fixed hole is located between the abutment terminal and the stop portion, a distance from the fixed hole to the stop portion is equal to a distance from the fixed hole to the abutment terminal.

5. The ventilation fan of claim 3, wherein the fixed hole, the stop portion and the abutment terminal are located at the same straight line.

6. The ventilation fan of claim 3, wherein the trace portion further comprises a notch, the abutment terminal abuts the surrounding of the opening so that the notch communicates with the opening, the electrical wire passes through the notch and the opening to connect to the fan module.

7. The ventilation fan of claim 6, wherein the notch is an arc notch.

8. The ventilation fan of claim 1, wherein the cover module further comprises a cover body, and the electronic device is connected to the cover body.

9. The ventilation fan of claim 1, wherein the adjustment element is rotatable to avoid a jam caused by the electrical wire when the fire damper body is detached from the link frame.

10. The ventilation fan of claim 1, wherein the fire curtains are fixed to a sidewall of the fire damper body.

11. The ventilation fan of claim 1, wherein the fire damper body is detachably linked up with the link frame by screw, latch, or concave-convex match.

12. The ventilation fan of claim 1, wherein the cover module is linked up with the fire damper module by screw, elastic sheet, or engaging piece.

13. The ventilation fan of claim 1, wherein the fan module is an axial fan module or a centrifugal fan module.

14. The ventilation fan of claim 1, wherein the adjustment element is a metal plate.

15. The ventilation fan of claim 1, wherein the electronic device is stereo set, smoke detector, lamp, light sensor, or control panel.

* * * * *